United States Patent [19]

Davies et al.

[11] 4,011,842

[45] Mar. 15, 1977

[54] PISTON MACHINE

[76] Inventors: Francis William Davies, 3366 Whittier Ave., Victoria, B.C., Canada, V8Z 3P9; Joseph Walcer, 7160 Veyaness Road, Saanichton, B.C., Canada, V0S 1M0

[22] Filed: Sept. 8, 1975

[21] Appl. No.: 611,305

[52] U.S. Cl. ..... 123/61 R; 417/343

[51] Int. Cl.[2] ..... F02B 75/28

[58] Field of Search ..... 123/51 BC, 56 BC, 56 B, 123/59 B, 61 R, 61 V, 62, 65 B, 59 BA, 59 BL, 197 AB, 197 AC; 74/579 E, 65; 92/138, 68; 417/343 R, 380

[56] References Cited

UNITED STATES PATENTS

| | | | |
|---|---|---|---|
| 2,157,764 | 5/1939 | Langrognet | 123/193 P |
| 2,295,037 | 9/1942 | Hedges | 123/61 R |
| 3,000,367 | 9/1961 | Eagleson | 123/61 R X |
| 3,903,854 | 9/1975 | Shelton | 123/65 B |

FOREIGN PATENTS OR APPLICATIONS

| | | | |
|---|---|---|---|
| 26,264 | 11/1907 | United Kingdom | 123/61 V |
| 904,002 | 8/1962 | United Kingdom | 123/56 BB |

*Primary Examiner*—Charles J. Myhre
*Assistant Examiner*—William C. Anderson
*Attorney, Agent, or Firm*—Carver and Company

[57] ABSTRACT

Reciprocating piston machine having a pair of spaced, parallel, double-ended cylinders straddling a crankshaft with a single crankpin. First and second double-ended pistons reciprocate within respective cylinders and are connected to crankshaft by T-shaped connecting member journalled on crosshead. Crosshead reciprocates on the crosshead guides positioned between and parallel to the cylinders. Connecting member has outer ends of piston connecting arms slidably and rotatably connected to pistons to accommodate changes in angle of connecting member, with outer end of crank connecting arm journalled on crankpin. Clearance openings extend between inner side walls of cylinder and crankcase to accept piston connecting arms, outer ends of openings serving as inlet ports. Exhaust ports are provided on generally opposite side of cylinder to inlet ports to permit efficient scavenging of spent charge. With symmetrical T-shaped connecting member, piston stroke exceeds total crank throw with increased piston dwell at ends of the piston stroke. Relative velocities between pistons produce couple on connecting member to sweep crankpin through its top and bottom dead-center positions. When used in two-stroke internal combustion engine, crankcase interior between cylinders is pressurized by crankshaft driven supercharger which forces fuel-air charge through inlet ports to attain four power strokes in one revolution of crankshaft.

14 Claims, 18 Drawing Figures

—Fig. 4—
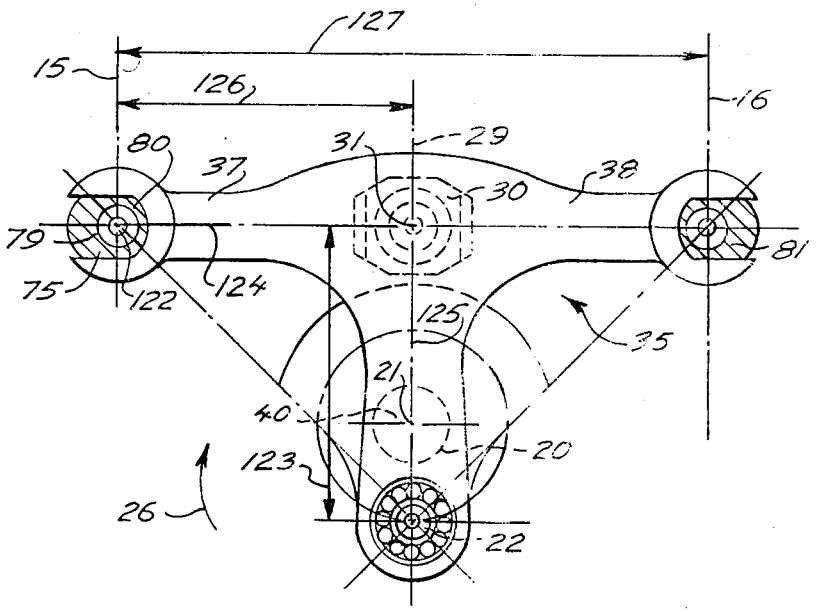
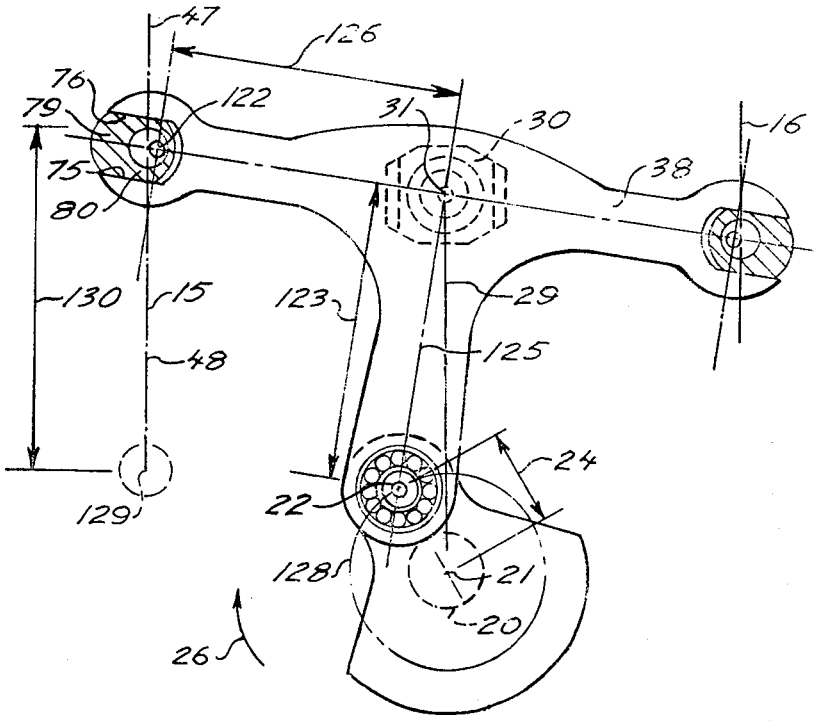
—Fig. 5—

PISTON MACHINE

BACKGROUND OF THE INVENTION

1. Field of the Invention

The invention relates to a reciprocating piston machine for use as a prime mover, either as an internal combustion engine or as an external combustion engine, or when supplied with power for use as a fluid pump or compressor.

2. Prior Art

Reciprocating piston machines have been known for many years, a common basic piston arrangement being a piston connected by a straight connecting rod to a crankpin carried on a crankshaft which rotates about a crankshaft axis. As the crankshaft rotates, the piston reciprocates within a cylinder having a longitudinal axis which intersects the crankshaft axis. Whilst this arrangement has many limitations and relative inefficiencies relating to the piston and crankshaft geometry, its mechanical simplicity and reliability has resulted in its almost universal adoption with many variations as the basic major prime mover mechanism. This basic mechanism has also been adopted in many types of reciprocating, positive displacement fluid pumps and compressors.

When this basic mechanism is used in an internal combustion engine, a first limitation relates to the comparatively short dwell of the piston at its top dead center position (TDC) prior to a power-stroke. Force generated by an expanding working gas in the combustion chamber cannot be fully utilized by the time the piston approaches the end of the power-stroke, particularly in relatively high speed two-stroke cycle engines in which the piston uncovers the exhaust port well before total energy in the gas has been utilized.

A second limitation of the common two-stroke engine is that the piston has a relative short dwell at bottom dead center (BDC) and the expanding gases from the power stroke are not fully scavenged from the cylinder. Because the piston dwell at BDC is relatively short, there is little time to induce a fresh charge into the chamber and thus high induction velocities are required which sometimes causes a portion of the fresh charge to be lost through the exhaust port. The two limitations above tend to reduce efficiency of the two-stroke engine. In a four-stroke cycle engine, the relatively short dwell of the piston at TDC similarly does not permit full utilization of available energy from the expanding gases in the combustion chamber.

A third limitation of the conventional piston machine relates to the basic geometry, in particular the line of action and direction of force from the connecting rod as it is applied to the crankshaft during the power stroke. Force from the expanding gas is applied to the crankshaft in a disadvantageous manner for most of the power stroke, thus reducing available output torque. As is well known, increasing throw of the crankpin and thus stroke of the piston can improve torque, but this increase results in higher piston speeds with other disadvantages and thus relatively long-stroke engines are not commonplace.

A fourth limitation of the basic engine relates to the application of the force from the piston to the crankshaft. The modern high compression engine has a relatively large bore and the total high compression forces are transmitted through the connecting rod and crankweb to the crankshaft. These forces require relatively massive components to sustain the high loads, and have correspondingly high inertia which is disadvantageous for reciprocating parts.

A fifth limitation relates to side forces between the piston and cylinder wall arising from the obliquely disposed connecting rod as it follows the piston through its stroke. The side forces cause assymetrical cylinder and ring wear and, other factors being equal, the wear increases as the connecting rod is made shorter. Thus compact or physically small engines with short connecting rods suffer from higher side forces than longer cylinder engines, which tends to aggravate cylinder wear.

As is well known, reciprocating pumps and compressors have corresponding and equivalent disadvantages relating to the piston and crankshaft geometry. As can be seen there are considerable limitations in basic engine design parameters which are inherent in the conventional mechanism.

SUMMARY OF THE INVENTION

The present invention reduces the difficulties and disadvantages of the prior art by providing a piston machine having increased piston dwell at top and bottom dead centers of the piston stroke and an improved application of force from the piston to the crankshaft. Furthermore, side forces between piston and cylinder walls, and compression and power-stroke forces acting on connecting members of the engine are reduced. Limitations relating to design parameters are also reduced which permits greater flexibility in design.

A reciprocating piston machine according to the invention has a crankcase and a crankshaft having a crankpin, the crankshaft being mounted for rotation relative to the crankcase about a main crankshaft axis. The engine includes first and second spaced parallel cylinders having cylinder axes straddling and disposed normal to the crankshaft axis, and first and second pistons mounted for reciprocation within the respective cylinders. The respective cylinders have inlet and exhaust ports with respective value means controlling the inlet and exhaust ports, the valve means being synchronized with the respective pistons to open and close the cylinder ports as required. The piston machine is further characterized by guide means within the crankcase disposed between and parallel to the cylinder axis, and a crosshead complementary to the guide means and mounted for reciprocation along the guide means, the crosshead having a journal. The piston machine also has a connecting member having a crank connecting arm and first and second piston connecting arms and a journal, the journal permitting the connecting member to be journalled for limited rotation on the crosshead. The first and second piston connecting arms have outer ends cooperating with the first and second pistons respectively, and the crank connecting arm has an outer end journalled on the crankpin. The pistons reciprocate within the respective cylinders, the connector rotates relative to the crosshead, and the crosshead reciprocates relative to the guides as the crankshaft rotates.

A detailed disclosure following, related to drawings, describes a preferred embodiment of the invention which however, is capable of expression in structure other than that particularly described and illustrated.

DESCRIPTION OF THE DRAWINGS

FIG. 4 is a simplified diagram of a connecting member, journalling means and crankshaft of the invention, FIG. 5 is a simplified diagram similar to FIG. 4, showing relative position of components after rotation of the crankshaft.

DETAILED DISCLOSURE

Figure 2:
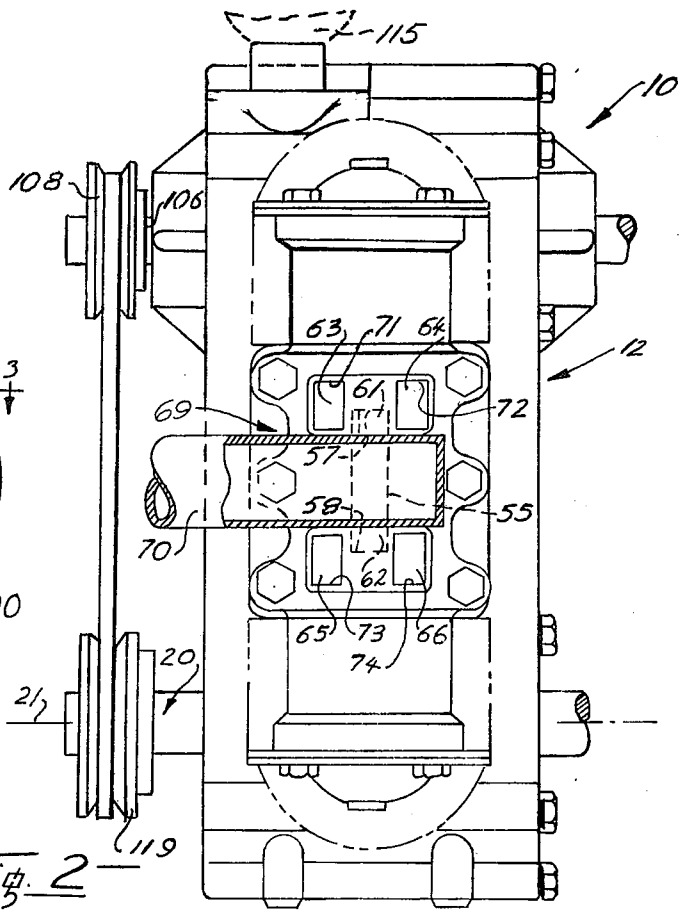
FIG. 2 is a fragmented end elevation of the engine generally on Line 2—2 of FIG. 1, some portions being removed to show some internal detail.
Figure 1:
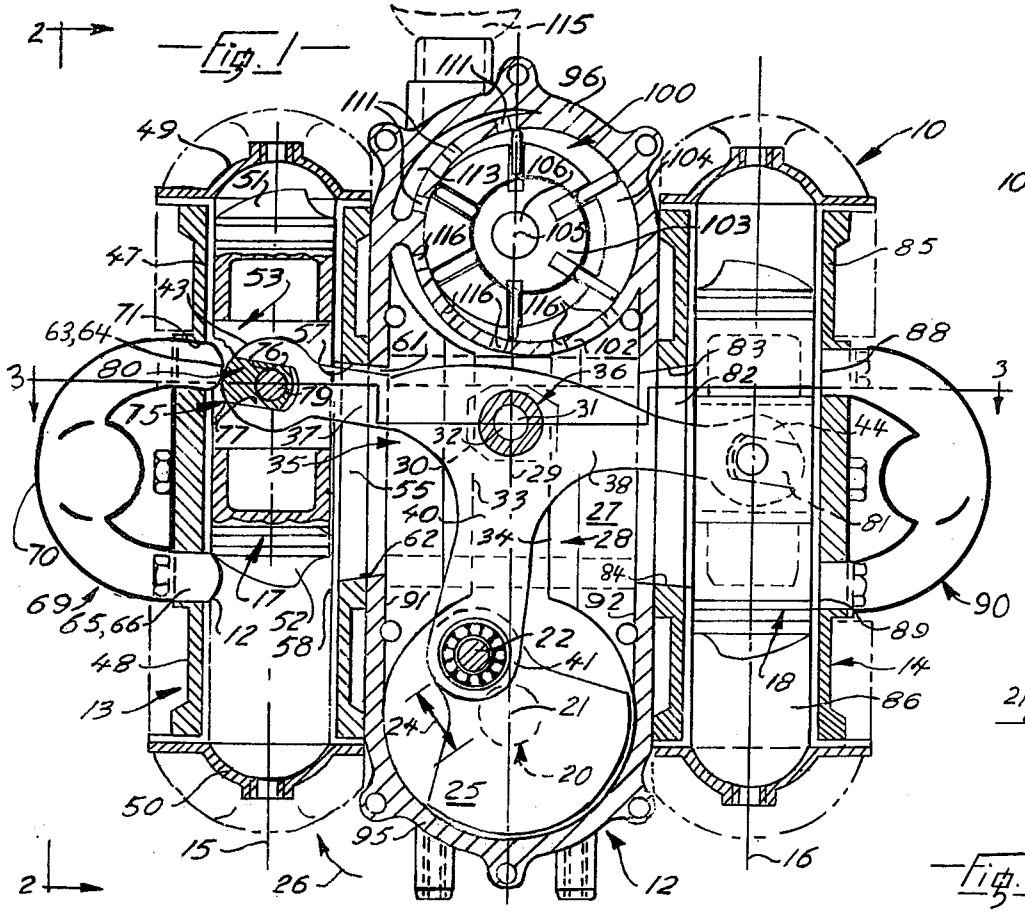
FIG. 1 is a simplified fragmented section through an engine according to the invention, the section plane being generally normal to the crankshaft axis, portions of the engine being removed to show internal detail.
Figures 3, 18:
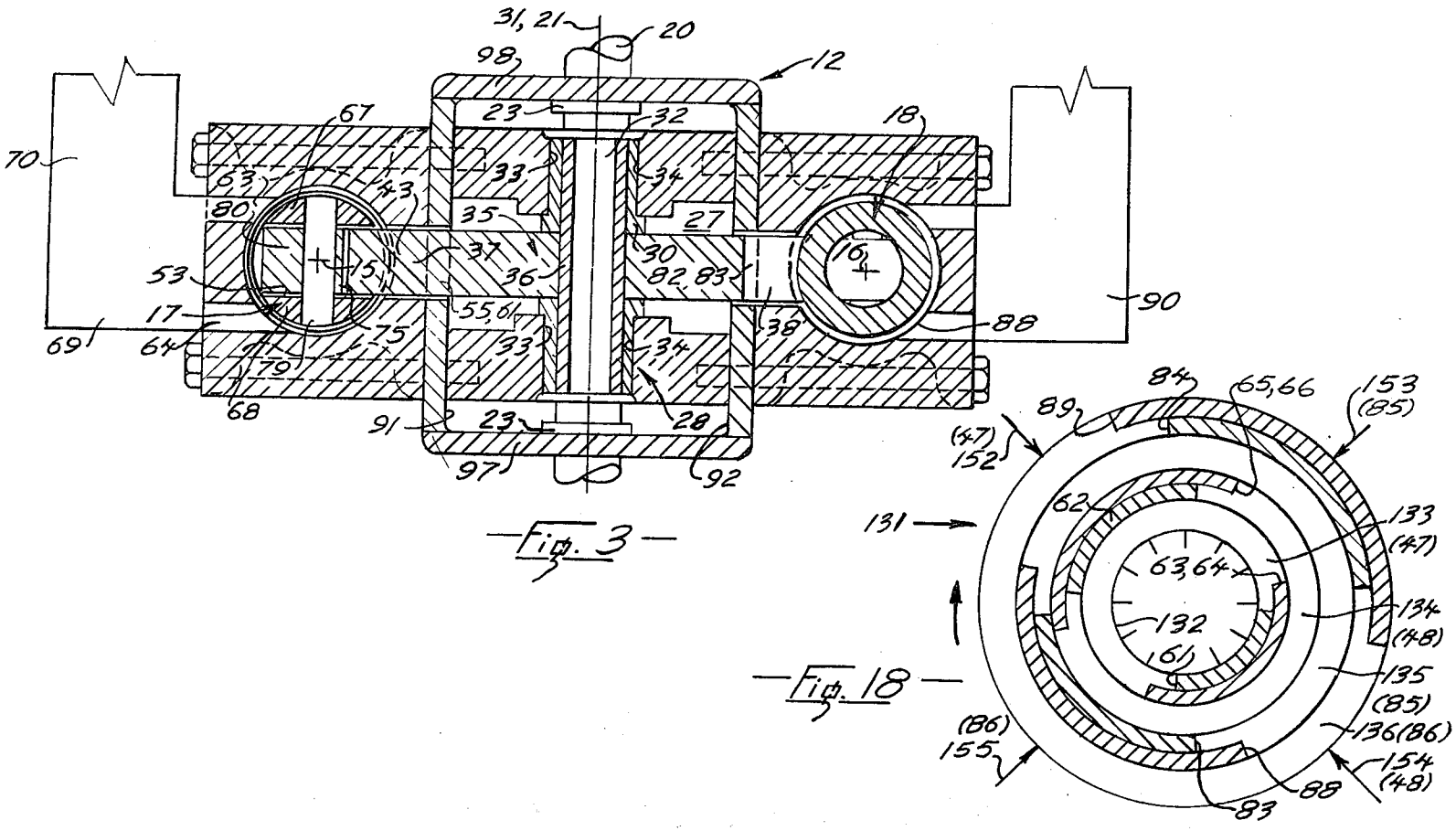
FIG. 3 is a simplified fragmented transverse section through portions of the engine generally on Line 3—3 of FIG. 1, some portions being removed.

FIGS. 1 through 3

Referring mainly to FIG. 1, one example of a reciprocating piston machine according to the invention is adapted to operate as an internal combustion engine in a two-stroke cycle and is designated 10. The engine has a crankcase 12, double-ended first and second cylinders 13 and 14 having first and second cylinder axes 15 and 16, and first and second double-ended pistons 17 and 18 mounted for reciprocation within the respective cylinders. The term "double-ended cylinder" refers to a cylinder having opposite ends closed by opposed cylinder heads, and the term "double-ended piston" refers to a piston having crowns at opposite ends. When the piston reciprocates within its cylinder a double-acting mechanism results.

The engine includes a crankshaft 20 having a crankshaft axis 21 and a crankpin 22 spaced from the crankshaft axis 21 by a crankthrow 24. The crankshaft is mounted for rotation relative to the crankcase about the crankshaft axis in spaced bearings 23. The crankshaft is similar to a conventional single throw crankshaft and has a counterweight incorporated in a crankweb 25. For symmetry of gas flow and motion of the parts, the engine is preferrably disposed with the cylinder axis horizontal and the crankshaft axis vertical. However, in the description following, top and bottom dead center positions of the crankpin relate to the disposition of the engine as shown in FIG. 1. Rotation of the crankshaft is in direction of an arrow 26.

The crankcase has an interior 27 having guide means 28 disposed between and parallel to the cylinder axes 15 and 16, the means 28 having a guide means axis 29 intersecting the crankshaft axis 21 and being within a central longitudinal plane of the crankcase. A crosshead 30, complementary to the guide means, is mounted for reciprocation along the guide means and has a crosshead pin 32 serving as a journal, the pin having an axis 31. The guide means 28 has opposed pairs of crosshead guides 33 and 34, which are flat bearing faces spaced to accept the crosshead therebetween for free sliding. A generally T-shaped connecting member 35 has a journal 36 for journalling on the crosshead pin to permit relative rotation between the crosshead and the connecting member. The member 35 has first and second aligned piston connecting arms 37 and 38 having equal lengths, with inner ends thereof adjacent the pin 32. The connecting member 35 also has a crank connecting arm 40 having a length generally equal to the length of one piston connecting arm, an inner end of the arm 40 being adjacent the pin 32 so that the connector has three generally equal arms extending from the journal as shown. The crank connecting arm 40 has an outer end 41 journalled on the crankpin 22 and the first and second piston connecting arms have outer ends 43 and 44 cooperating with the first and second pistons respectively by journalling means to be described.

The first cylinder 13 has aligned first and second cylinder portions 47 and 48 with respective cylinder heads 49 and 50. The first piston 17 has spaced first and second crowns 51 and 52 at opposite ends thereof, and an axially disposed piston slot 53 at the middle to accept the piston connecting arm 37 as will be described. Ignition means such as spark plugs, not shown, are provided in the cylinder heads and are actuated by a common ignition circuit, not shown. Each cylinder portion has a cylinder wall complementary to the piston, which has piston rings as required.

The first cylinder 13 has an axially disposed clearance opening 55 in the cylinder wall thereof, the opening 55 communicating with the interior 27 of the crankcase to provide clearance for the piston connecting arm 37 to pass therethrough to cooperate with the first piston. The clearance opening 55 is an elongated slot in the cylinder wall disposed parallel to the cylinder axis and having a width sufficient to accept freely the arm 37. The slot has spaced end walls 57 and 58 which are spaced apart sufficiently to accommodate full swinging and rotational movement of the connecting member 35, as will be described with reference to FIGS. 6 through 17. The end walls define in part outer portions of first and second inlet ports 61 and 62 for the respective first and second cylinder portions.

Referring to FIG. 2, outer portions of cylinder walls of the first and second cylinder portions have spaced openings 63 through 66 serving as first and second pairs of exhaust ports, a branched exhaust manifold 69 communicating with the exhaust ports to conduct the exhaust gases to a common exhaust pipe 70 having sound suppression means as required. The exhaust ports 63 through 66 have outer end walls 71 through 74 positioned axially in the cylinder relative to the piston crowns of the piston 17 similarly to position of the exhaust port and piston crown of a common two-stroke cycle engine, as will be described.

As shown only in FIG. 3, the inlet port 61, that is the outer portion of the clearance opening 65, is positioned on the inner side of the cylinder wall, whereas the exhaust ports 63 and 64 are spaced circumferentially at approximately 150 degrees from the inlet port 61 so as to be on a diameter different from that of the arm 37. Such spacing is so that the opening 55 and exhaust ports 63 and 64 cannot be connected by the piston slot 53, which extends diametrically across the piston 17 and might otherwise pass the gases. Alternative piston and exhaust port positioning can be devised to function similarly so that the piston can close off simultaneously both the inlet and exhaust ports of a particular cylinder portion as in a common two-stroke cycle engine.

Referring to FIG. 1, when the piston is at an outer end of its stroke, the end walls of the inlet and exhaust ports are located axially relative to the piston crown at particular positions so that the piston opens and closes the valves at particular positions of the crankpin. Thus, when the first piston 17 is at the top dead center of the first cylinder portion, the inlet port 61 and the exhaust ports 63 and 64 of the first cylinder portion 47 are closed by the piston prior to a power stroke, and the inlet port 62 and the exhaust ports 65 and 66 of the second cylinder portion 48 are open so as to accept a fresh charge from the crankcase and exhaust a spent charge as will be described. The piston crowns 51 and 52 are shaped so as to provide efficient inlet flow through the inlet port and into the combustion chamber, with adequate scavenging of the spent charge through the exhaust port with little carry-over of the fresh charge. The piston crowns are shaped and positioned relative to the inlet and exhaust ports of a particular cylinder portion to attain loop scavenging, as is common practice in high-performance two-stroke cycle engines. Thus the cylinder wall of each cylinder portion has an inlet port communicating with the interior of the crankcase to receive a fresh charge from the crankcase, and an exhaust port to exhaust a spent charge from the cylinder portion, and, similarly to a common two-stroke cycle engine, the piston serves as a valve means controlling the inlet and exhaust ports as required.

The outer end 43 of the piston connecting arm 37 has an axially disposed arm slot 75 disposed normally with respect to the piston connecting arm and the respective cylinder axis. The arm slot 75 is defined in part by spaced parallel sidewalls 76 and 77, space between the walls defining slot width. The first piston 17 has a wrist pin 79 and a slide block 80 in the piston slot 53, outer ends of the wrist pin being journalled in complementary bores in portions of opposed walls 67 and 68 of the piston straddling the slot 53. The slide block has spaced parallel side faces spaced apart a distance somewhat less than width of the slot 75 to provide for the slide block a sliding fit within the slot 75. An inner portion of the wrist pin is journalled in a complementary bore in the slide block, the bore being parallel to the side faces of the slide block.

As will be described with reference to FIGS. 4 and 5, as the piston 17 reciprocates, the slide block 80 slides axially relative to the arm 37 within the slot 75, and the block rotates relative to the piston about the wrist pin 79 through a limited arc. Thus the slide block is a journalling means cooperating with the wrist pin and piston so that the piston can slide axially and simultaneously rotate relative to the piston connecting arm.

In the second double-ended cylinder 14, the second piston 18 has a similar slide block 81 and cooperates similarly with the second piston connecting arm 38 through a similar second clearance opening 82 communicating the second cylinder with the interior 27 of the crankcase. Outer ends of the opening 82 serve similarly as inlet ports 83 and 84 for the first and second cylinder portions 85 and 86 of the second cylinder 14. The second cylinder has spaced pairs of openings serving as exhaust ports 88 and 89 for the first and second cylinder portions 85 and 86, which ports cooperate similarly with an exhaust manifold 90. The pistons 17 and 18 and the cylinders can thus be generally interchangeable between opposite sides of the crankcase, thus facilitating manufacturing and spares inventory.

The crankcase 12 has a pair of spaced parallel generally plane side walls 91 and 92 and first and second generally semi-circular end walls 95 and 96 connecting together adjacent ends of the side walls. Axes of arcs of the semi-circular end walls are disposed generally within a plane containing the guide means axis 29 so as to form a generally oval-sectioned crankcase as viewed along the axis 21. The crankshaft axis 21 is concentric with the axis of the first cylindrical end wall 95 so that the crankweb 25 can rotate within a semi-circular cavity formed adjacent the end wall 95. As seen only in FIG. 3, the side walls and end walls of the crankcase are capped by plates 97 and 98, thus closing the crankcase to form a chamber disposed between the two cylinders. The double-ended cylinders are secured to opposite sides of the crankcase by undesignated bolts and the plates 97 and 78 are similarly secured to the crankcase. It can be seen that dismantling and assembling of the engine is therefore a simple matter.

A guided vane gas pump 100 is provided adjacent the end wall 96, and has a semi-circular shroud 102 which, with the end wall 96, defines a cylindrical chamber 104. The pump has a rotor 103 carrying a plurality of vanes which sweep the chamber 104 as the rotor rotates about a pump axis 105. The chamber is closed by the plates 97 and 98 and has a side wall disposed eccentrically relative to the pump axis 105, which axis is generally within the plane containing the guide means axis 29. The rotor is carried on a drive shaft 106 journalled within the plates of the crankcase, the shaft being driven by a pump pulley 108 and a vee belt 109, shown in FIG. 2 only. The pump has a plurality of inlet ports 111 provided in a portion of the end wall 96, the inlet ports communicating with an inlet manifold 113 connected to a carburetor 115, shown partially in broken outline. The semi-circular shroud 102 has a plurality of outlet ports 116, which connect the chamber 104 of the pump with the interior 27 of the crankcase. Thus it can be seen that, as the pump rotates, an air-fuel mixture drawn from the carburetor through the inlet manifold 113 is compressed by the pump 100, and fed through the outlet ports 116 into the interior 27 of the crankcase, thus pressurizing the crankcase to a few psi above atmospheric pressure. The engine thus has positive or super-charged induction, contrasting with most two-stroke engines which use crankcase suction induced by a rising piston. It is noted that the crankcase suction of a common two-stroke cycle engine is not attained in the present engine because reciprocation of the pistons within the respective cylinders does not change appreciably over all crankcase pressure.

The crankshaft 20 has an output portion 117 carrying drive means, not shown, and at an opposite end it has a crankshaft pulley 119, which carries the vee belt 109 and is aligned with the pump pulley 108. The pulleys 108 and 119 are a complementary pair of variable speed pulleys so that as the crankshaft speed changes the ratio between the crankshaft rotation and the pump rotation also changes. The pump 100 thus serves as a variable speed super-charger which can be adjusted so that, as the engine speed increases, degree of supercharging increases in an amount dependent on power output and the ratio between the pulleys.

As is common two-stroke practice, oil can be premixed with the fuel prior to carburetion so that as the fuel-air mixture passes through the pump 100 and the interior of the crankcase to the inlet ports of the combustion chambers, the pump 100, the crosshead 30, the guide means 28, the slide block 80, the wrist pin 79, the crankshaft 20 and the crankpin 22 are suitably lubricated. Alternative lubrication means can be devised, however the premixed lubricant in the fuel is preferred for simplicity.

FIGS. 4 and 5

In FIG. 4, the connecting member 35 is shown when the crankpin is at bottom dead center, termed crank BDC, which, contrasting with prior art piston machines, does not correspond with bottom dead center of a particular piston, termed piston BDC, of any of the cylinder portions. Similarly when the crank is at top dead center, termed crank TDC, none of the pistons are at piston TDC. In the position shown, the piston connecting arms are generally normal to the cylinder axes and the slide blocks 80 and 81 are located at innermost positions in the slots at ends of the piston connecting arms. For convenience of reference, when considering the T-shaped connecting member 35, a slot datum point 122 for the slot 75 is defined by intersection of the cylinder axis 15 with an axis 124 of the piston connecting arm 37 when an axis 125 of the arm 40 extends parallel to the guide means axis 29. Spacing 126 between the datum 122 and the crosshead pin axis 31 defines length of the piston connecting arm 37 and is one-half of inter-cylinder spacing 127 between the cylinder axes 15 and 16. When the axis 125 is positioned as shown in FIG. 4, the datum point 122 coincides with a central longitudinal axis of the wrist pin 79. Spacing 123 between a central axis of the crankpin 22 and the pin axis 31 defines length of the crank connecting arm 40 which is equal to the spacing 126. Thus the member 35 has three arms of equal length extending from the journal.

Referring to FIG. 5, as the crankshaft rotates about the axis 21, the crankpin 22 describes an orbit 128, the crosshead 30 slides along the axis 29 and the connecting member 35 rotates through limited arcs relative to the crosshead 30. As the member 35 rotates from the position shown in FIG. 4, there is an increase in spacing between the wrist pins which are constrained by the cylinders to reciprocate along the cylinder axes. To accommodate the increase in spacing, the slide blocks slide laterally outwards in their respective slots so that the central axis of the wrist pins are no longer coincident with the respective slot datum points. Movement of the blocks within the slots is not excessive, and for a connecting member having piston connecting arms and a crank connecting arm of equal length of 5 cms., maximum movement of the block within the slot is of the order of 3 mms. The wrist pin 79 is shown positioned below an approximate uppermost position on the cylinder axis 15, i.e. a position corresponding to piston TDC for the cylinder portion 47, which occurs when the crankpin passes between 30 and 60 degrees before crank TDC. The wrist pin has a lowermost position 129 on the axis 15 which corresponds to piston BDC for the cylinder portion 47 or piston TDC for the cylinder portion 48. The wrist pin attains the position 129 between 30 and 60 degrees before crank BCD and spacing 130 between uppermost and lowermost positions of the wrist pin represent stroke of the piston. For a connecting member having the dimensions stated above and connected to a crankshaft having a throw 24 of 1.1 cms., the piston stroke would be about 7.2 cms. Throughout operation of the engine as described with reference to FIGS. 6 through 17, lateral movement of the wrist pin relative to the connecting member as above particularized is understood.

OPERATION

FIGS. 6 through 18

In the twelve figures 6 through 17 following, undesignated arrows on the pistons 17 and 18 indicate direction of motion of the pistons for each 30° increment of rotation of the crankshaft in the direction of the arrow 26. Undesignated arrows at the inlet ports 61, 62, 83 and 84 and the exhaust ports 63 through 66 and 88 and 89 indicate direction of gas flow through the ports. FIG. 18 shows a composite valve timing diagram 131 in which the incremental crankpin positions correspond to undesignated radii at similar angles in an inner circle 132. In FIG. 18, portions of one revolution of the crankshaft in which the inlet and exhaust ports of the cylinder portions 47, 48, 85 and 86 are open are shown approximately in cross-hatched arcs of concentric circles 133 through 136 respectively. Inlet ports are shown in an inner arc, exhaust ports are shown in an adjacent outer arc.

Figure 6:
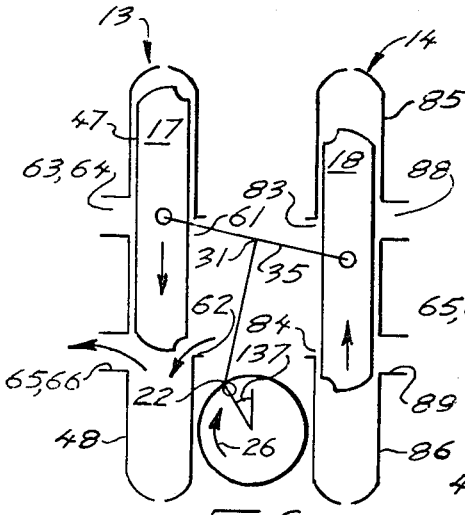
FIGS. 6 through 17 are sequence diagrams at 30° intervals showing the relative positions of pistons, connecting member and crankpin, through one complete revolution of the crankshaft, FIG. 18 appearing on Sheet 2 of the drawings, is an approximate valve timing diagram of the engine.

In FIG. 6, the piston 17 is initiating a power stroke and accelerating following piston TDC for the first cylinder portion 47, the crankpin being disposed at a crankpin angle 137, which is 30 degrees before crankpin TDC. The inlet port 61 and the exhaust ports 63 and 64 of the cylinder portion 47 are closed by the piston 17 following a compression stroke near the end of which ignition occurs, shown as arrow 152 in FIG. 18. For the cylinder portion 48, the piston 17 has just completed a power stroke and the inlet port 62 and the exhaust ports 65 and 66 remain open to admit a fresh charge from the crankcase interior and discharge a spent charge, as in a common two-stroke cycle. The piston 18 is at approximately mid-stroke position during a compression stroke in the cylinder portion 85 and a power stroke in the cylinder portion 86, and the inlet ports 83 and 84 and the exhaust ports 88 and 89 of the cylinder 14 are all closed.

Figure 7:
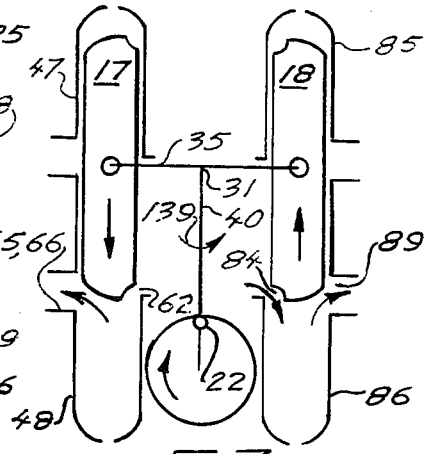

In FIG. 7, the crankpin is at crankpin TDC and the piston 17 is still accelerating from the power stroke in the cylinder portion 47 and is closing the inlet port 62 and exhaust ports 65 and 66. The piston 17 thus prevents further entry of the fresh charge from the crankcase, and simultaneously completes the exhausting of a spent charge from the cylinder portion 48. Simultaneously, the piston 18 is decelerating and is uncovering the inlet port 84 and the exhaust port 89 of the second cylinder portion 86, to admit a fresh charge into the second cylinder portion 86, whilst concurrently exhausting a spent charge therefrom. It is noted that the pistons 17 and 18 are travelling in opposite directions as the crankpin 22 passes over the crank TDC. A couple is thus generated on the connecting member 35 tending to rotate it about the crosshead pin axis 31 and thus tending to sweep the crank connecting arm 40 through an arc. This couple is similar to a toggle action and, as shown by an arrow 139, sweeps the crankpin 22 over the normally relatively poor mechanical advantage position of the crankpin at its TDC. This toggle action is relatively strong because the piston 17 is accelerating at the start of its power stroke, and the piston 18 is still travelling relatively fast as it approaches an end of its power stroke.

Figure 8:
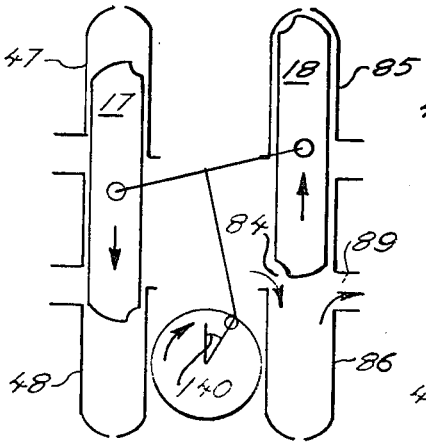

In FIG. 8, crankpin angle 140 is 30 degrees after crank TDC and the piston 17 is at approximately mid-stroke and is starting to compress the fresh charge in the cylinder portion 48, whilst the piston 18 is rapidly decelerating as it approaches piston TDC prior to a power stroke in the cylinder portion 85. In the cylinder portion 86 a fresh charge enters through the inlet port 84 and the spent charge leaves through the exhaust port 89.

Figure 9:
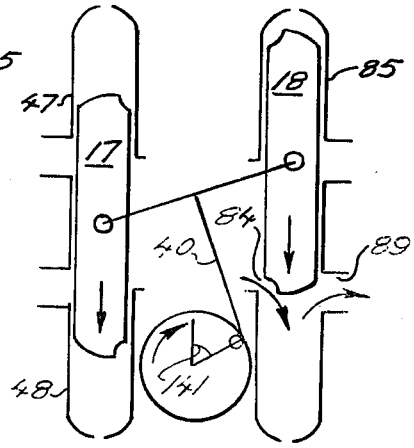

In FIG. 9, crankpin angle 141 is 60 degrees after crank TDC and the piston 17 is decelerating to compress the charge in the cylinder portion 48. In the cylinder portion 85 the piston 18 is accelerating after ignition, shown by an arrow 153 in FIG. 18, and during its power stroke it starts to close the inlet and exhaust ports 84 and 89. It is noted that both pistons 17 and 18 are now travelling in the same direction, the piston 17 leading the piston 18 whilst approaching their respective second cylinder portions. It is also noted that the crank connecting arm 40 is inclined at approximately 90 degrees to the crankpin radius and thus is operating at approximately maximum mechanical advantage for applying force to attain maximum torque from the crankshaft. Thus both pistons are moving together and resultant force of these two pistons is applied to the crankshaft at a crankpin angle which is approaching optimum, thus the crankshaft can utilize energy of the pistons more efficiently and for a longer time than in conventional piston engines.

Figure 10:
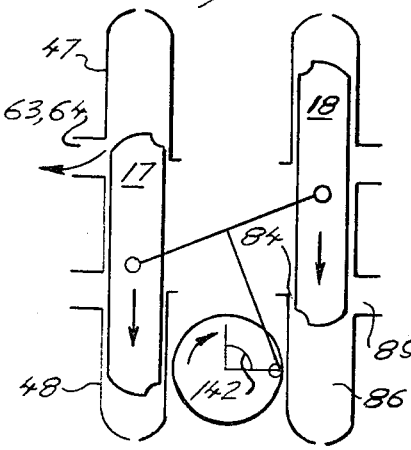

Referring to FIG. 10, at a crankpin angle 142 of 90° after crank TDC, both pistons 17 and 18 are travelling in the same direction, with piston 17 decelerating whilst the piston 18 attains its maximum velocity. The exhaust ports 63 and 64 of the first cylinder portion 47 are starting to open to exhaust the spent charge from the first cylinder portion, whilst the inlet and exhaust ports 84 and 89 of the cylinder portion 86 are now closed by the piston 18.

Figure 11:
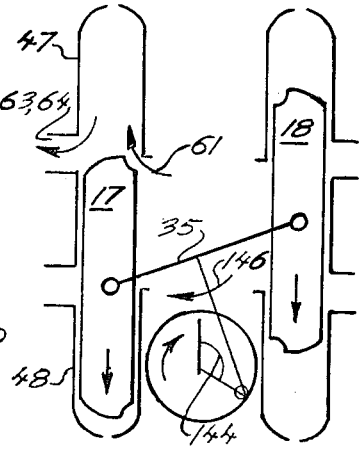

In FIG. 11, at a crankpin angle 144 of 120°, the piston 17 is still decelerating and approaching TDC for the cylinder portion 48 and the spent charge from the cylinder portion 47 is being exhausted through the ports 63 and 64 and a fresh charge is entering through the inlet port 61. The piston 18 is still travelling relatively fast downwards and thus the piston velocity difference creates a second couple or toggle action to the connecting member 35 in direction of an arrow 146, thus tending to sweep the crankpin 22 through crank BDC.

Figure 12:
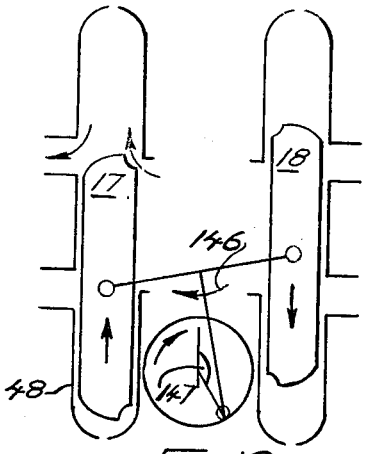

In FIG. 12, at a crankpin angle 147 of 150°, with reference to the cylinder portion 48, after ignition, designated by an arrow 154 in FIG. 18, a power stroke is initiated and the piston 17 now travels in an opposite direction to the piston 18. Thus the above mentioned second toggle action designated by the arrow 146 is augmented as the piston velocity differences increase so as to subject the crankpin 22 to an essentially continuous sweeping force as it approaches and passes crank BDC.

Figure 13:
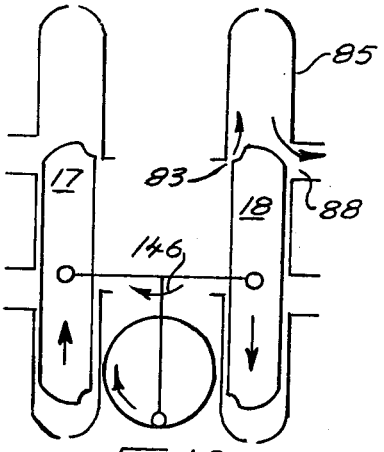

In FIG. 13, at crank BDC, both pistons are still travelling in opposite directions and the second toggle action is still effective in maintaining rotation of the crankshaft past the normally disadvantageous crank BDC position. The inlet and exhaust ports 83 and 88 of the cylinder portion 85 are open to admit a fresh charge and exhaust a spent charge for the cylinder portion 85.

Figure 14:
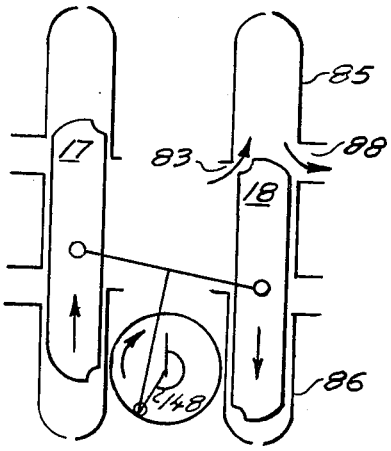

In FIG. 14, at a crankpin angle 148 of 210°, the piston 18 is approaching piston TDC for the cylinder portion 86, and is continuing to admit the fresh charge and discharge the spent charge from the first cylinder portion 85. All the inlet and exhaust ports controlled by the piston 17 are closed.

Figure 15:
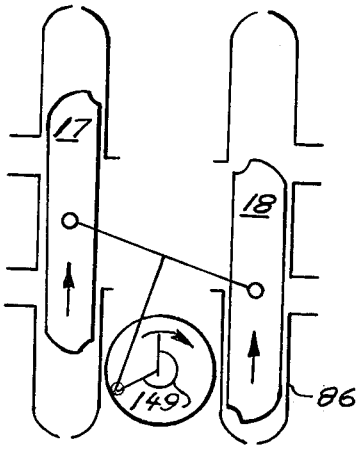

In FIG. 15, at a crankpin angle 149 of 240°, the piston 17 is approaching maximum velocity with the respective inlet and exhaust ports still closed, and in the cylinder portion 86 after ignition, shown by an arrow 155 in FIG. 18, the piston 18 commences a power stroke in the same direction as the piston 17.

Figure 16:
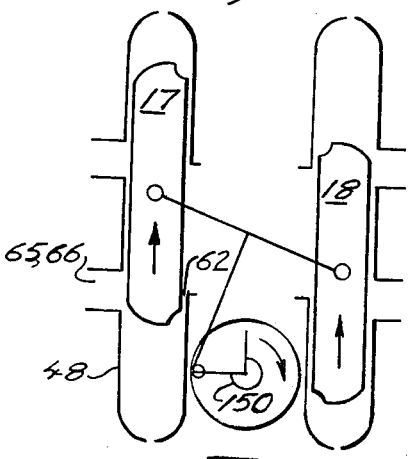
Figure 17:
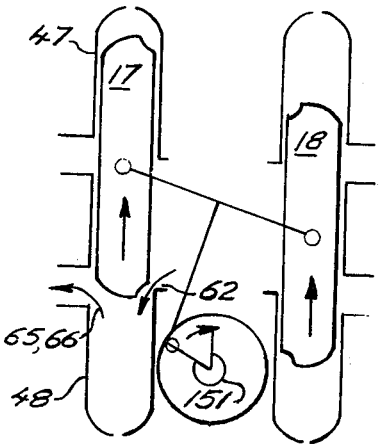

In FIGS. 16 and 17, as the crankpin angles 150 and 151 change from 270° to 300° respectively, the piston 17 opens the inlet port 62 and the exhaust ports 65 and 66 of the cylinder portion 48, and continues compressing a fresh charge in the cylinder portion 48. Both pistons are now travelling in the same direction and are applying force to the crankshaft at a crankpin position approaching optimum, thus effectively using energy of both power strokes. A further 30 degrees of crankshaft rotation returns the pistons to positions as shown in FIG. 6 to repeat the cycle.

Thus in crankpin positions occuring slightly before the positions shown in FIG. 6, 9, 12 and 15, and by the arrows 152 through 155 in FIG. 18 respectively, ignition occurs at approximately every 90 degrees of crankshaft rotation in the cylinder portion 47, 85, 48 and 86 respectively. Thus four power strokes occur in one revolution of the crankshaft. Clearly ignition occurs in each cylinder at a position favourable to that particular piston during its stroke, and this ignition is likely to be somewhat advanced, eg. before piston TDC for that particular cylinder, depending on engine rpm, and other well known variables. Note that increased piston dwell at piston TDC permits reduction of ignition advance when compared with conventional engines.

Summarizing the engine motion, it is noted that as the crankpin approaches crank TDC and crank BDC positions, i.e. at positions between approximately 45 degrees before and after crank TDC and BDC, the pistons are travelling in opposite directions and thus apply a strong toggle action or couple to the connecting member 35, tending to sweep the crankpin past the crank TDC and BDC positions. In a common single cylinder, two or four-stroke cycle engine, when the crankpin approaches BDC or TDC, the useful driving force from the power stroke has been essentially exhausted and the crankpin is swept through these positions mainly by flywheel momentum. Thus the present engine could use a lighter flywheel and would be less vulnerable at crank BDC and TDC. It is also noted that, as the crankpin swings through crankpin positions between approximately 60° after crank TDC and before crank BDC, and 60° after crank BDC and before crank TDC, both pistons are moving in the same direction, thus applying essentially simultaneously both power strokes to the crankshaft at a position approaching optimum for mechanical advantage, i.e. crank connecting arm is normal to crank throw. This contrasts with prior art engines which apply force efficiently to the crankpin for a relatively short period of crankshaft rotation.

A further advantage relates to the double-ended pistons 17 and 18 in which force from an explosion on one piston crown is cushioned substantially by resistance to compression on the opposite piston crown, thus reducing net forces on the crankshaft and connecting member assembly, permitting use of smaller components and thus reducing mass of reciprocating parts. It is also noted that induction pressure in the crankcase, i.e.

crankcase compression, is essentially constantly above atmospheric pressure and is available as soon as an inlet port is uncovered, thus permitting relatively fast induction of a fuel-air mixture into the cylinder portion, thereby improving volumetric efficiency.

An advantage relating to the particular means of connecting the pistons to the connecting member is that the side forces on the pistons are considerably reduced from those present in normal reciprocating engines. This is because the connecting member has a sliding fit relative to the piston and oblique forces resulting from the relative crankpin position are carried primarily by the crosshead guides 33 and 34. The guides can be machined for suitable rigidity and alignment, contrasting with the normal engine in which the piston and its rings withstand the oblique forces, which in time results in ovalling of the cylinders.

Geometry of the connecting member and crosshead provides a longer than usual dwell of the piston at TDC for each cylinder portion, thus permitting a rapid build-up of combustion pressure prior to the power stroke. This permits extraction of more power from the expanding gas than in a conventional piston engine, in which the piston has a relatively short dwell at TDC. The geometry of the connecting member and crosshead thus permits improved utilization of effective pressure in the combustion chamber during the power stroke. The geometry also provides a wider than normal variation in the relative disposition of the inlet and exhaust ports and the piston crown, thus providing a greater tolerance in selecting particular engine performance characteristics.

With reference to FIG. 18, it is to be understood that this is only an approximate representation of the valve and ignition timing and that significant variations from this are contemplated. FIG. 18 shows that the exhaust port for a particular cylinder portion is open for approximately 125° of crankshaft rotation and the inlet port is open for approximately 90° of crankshaft rotation. Mid-position of the exhaust port opening coincides approximately with mid-position of the inlet port opening, that is the inlet port opening is symmetrical relative to the exhaust port opening with approximately 17° of exhaust port opening at either end in which there is no valve overlap. This can be compared with a common basic two-stroke engine using transfer port induction from crankcase compression, in which the exhaust port opens at about 90° to 110° after TDC and closes at about 250° to 270° after TDC and the equivalent inlet port, i.e. the transfer port, opens at 115° to 140° after TDC and closes at 220° to 245° after TDC. This, in the common two-stroke cycle engine the exhaust port is open for a period of between 140° and 180°, and the inlet port is open for a period of between 80 and 130°. It is noted that in view of the differences in geometry between the prior art structure and the present invention, a comparison of piston motion based solely on respective crankpin positions is not a complete comparison and other comparison means can be devised. It has been found that, for a given crank throw, the power stroke of the present engine is longer than the power stroke of a conventional engine thus permitting greater utilization of combustion chamber pressure. Also the inlet port of the present engine is generally open for a shorter period than the transfer port of a conventional engine, but the essentially constant induction pressure in the present engine is sufficient to ensure adequate charging.

ALTERNATIVES AND EQUIVALENTS

Referring to FIG. 5, spacing 130 between the uppermost and lowermost positions of the wrist pin 79 represents total movement or stroke of the piston 17, and total movement or stroke of the crosshead 30 is twice crankthrow 24. When the spacing 126 between the datum 122 and the crosshead pin axis 31 and the spacing 123 between the pin axis 31 and the axis of the crankpin 22 are each 5 cms, the axes thus forming an essentially isosceles triangle, and the crankthrow is 1.1 cms, it is found that the piston stroke is approximately 7.2 cms. Thus ratio of piston stroke to the total crankthrow is approximately 7.2 to 2.2 cms. Thus contrasts with a common piston engine in which the total crankthrow is equal to the piston stroke. In the engine according to the invention, the piston stroke is therefore longer than the crankthrow and thus can be similar to a long stroke engine thus permitting a greater period of time for extraction of energy from a power stroke, without incurring increased side forces on the piston as might be the case with a common long stroke engine. Clearly, by increasing the spacing 126 the piston stroke can be further increased relative to a constant crankthrow and thus may have advantages in some applications. Furthermore, by changing the crankthrow and the spacing 123 a wide range of ratios of piston stroke: total crankthrow is obtainable.

If a non-symmetrical connecting member is used, that is length of the piston connecting arms 37 and 38 are different, the engine is capable of non-symmetrical motion, which would have particular advantage in steam engines. In a steam engine, advantage could be gained by increasing the bore of the second cylinder which could operate at reduced steam pressure as in a compound engine. In this case the length of the second piston connecting arm could be increased to provide greater torque. In the steam engine embodiment, known valve linkages could be used to control steam valving.

By providing suitable spring-closed poppet valves in each cylinder head, and eliminating the two-stroke cycle ignition means, exhaust and inlet ports as described, and providing means to rotate the crankshaft, the piston machine could serve as a liquid pump or gas pump or compressor obtaining many of the advantages resulting from the geometry of the piston motion.

We claim:

1. A reciprocating piston machine characterized by: a crankcase, a crankshaft having a crankpin and being mounted for rotation relative to the crankcase about a crankshaft axis; first and second spaced parallel cylinders having cylinder axes straddling and disposed normally to the crankshaft axis; first and second pistons mounted for reciprocation within the respective cylinders; inlet and exhaust ports in the respective cylinders; valve means controlling the inlet and exhaust ports and synchronized with the respective pistons to open and close the cylinder ports as required; the machine being further characterized by:

i. a guide means within the crankcase disposed between and parallel to the cylinder axes, ii. a crosshead complementary to the guide means and mounted for reciprocation along the guide means, the crosshead having a journal, iii. a connecting member having a crank connecting arm, first and second piston connecting arms, and a journal to journal the connecting member on the journal of the crosshead, the crank connecting arm journalled on the crankpin and the first and second piston connecting arms having outer ends cooperating with the first and second pistons respectively, so that the pistons reciprocate within the respective cylinder, the connecting means rotates relative to the crosshead, and the crosshead reciprocates relative to the guide means with rotation of the crankshaft.

2. A reciprocating piston machine as claimed in claim 1 in which the connecting member is characterized by:

i. the first and second piston connecting arms having equal lengths and inner ends thereof adjacent with the journal of the connecting member, ii. the crank connecting arm having a length generally equal to the length of a piston connecting arm with an inner end of the crank connecting arm being similarly adjacent the journal, so that the connector has three generally equal arms extending from the journal thereof.

3. A reciprocating piston machine as claimed in claim 1 in which:

i. the pistons are double-ended and have spaced crowns, ii. the cylinders straddle the crankcase and are correspondingly double-ended and have aligned first and second cylinder portions with respective cylinder heads, iii. the outer ends of the piston connecting arms cooperate with the respective pistons for limited rotation and sliding relative to the respective piston, iv. the double-ended cylinders have clearance openings in cylinder walls thereof to communicate with the interior of the crankcase, the openings providing clearance for the piston connecting arms to pass therethrough to cooperate with the respective pistons.

4. A reciprocating piston machine as claimed in claim 3 in which the connecting member is characterized by:

i. the piston connecting arms being aligned to extend between the cylinders, ii. the crank connecting arm extending normally from the piston connecting arms, so as to form a generally "T" shaped connecting member.

5. A reciprocating piston machine as claimed in claim 3 in which:

i. each piston connecting arm has an outer end having an axially disposed slot disposed normally to the piston connecting arm and normally to the respective cylinder axis, ii. each piston has a wrist pin and journalling means cooperating therewith, the journalling means cooperating with the wrist pin and piston so that the piston can slide axially and simultaneously rotate relative to the piston connecting arm.

6. A reciprocating piston machine as claimed in claim 5 in which the journalling means of the piston includes a slide block having:

i. a bore to accept the wrist pin, and a pair of flat parallel faces disposed within planes parallel to a central axis of the wrist pin, the faces being spaced apart to provide a sliding fit of the slide block in the slot at the end of the piston connecting arms.

7. A reciprocating piston machine as claimed in claim 3 in which the machine is adapted to operate as an internal combustion engine in a two-stroke cycle, the machine further including:

i. a gas pump communicating with the interior of the crankcase to supply a pressurized gas to the interior of the crankcase, and in which each cylinder portion is characterized by a cylinder wall complementary to the piston, and ignition means to initiate combustion of a charge, ii. the cylinder wall having an inlet port communicating with the interior of the crankcase to receive a fresh charge from the crankcase, and an exhaust port to exhaust a spent charge from the cylinder portion.

8. A reciprocating piston machine as claimed in claim 7 in which:

i. the gas pump is coupled to the crankshaft so as to rotate therewith to supply compressed gas for combustion in an amount generally proportional to speed of rotation of the crankshaft.

9. A reciprocating piston machine as claimed in claim 7 in which:

i. the inlet ports and clearance opening of one particular double-ended cylinder are defined by an elongated slot in the cylinder wall disposed parallel to the cylinder axis, the slot having spaced end walls which define in part outer edges of inlet ports for the respective opposed first and second cylinder portions, the end walls being positioned relative to the piston crowns at outer ends of the respective stroke so that, initially when the particular piston is at top dead center of the first cylinder portion the inlet and exhaust ports of the first cylinder portion are closed by the piston prior to a power-stroke and the inlet and exhaust ports of the second cylinder portion are open so as to accept a fresh charge from the crankcase and to exhaust a spent charge from a power stroke, and as the particular piston moves from the first cylinder portion into the second cylinder portion, the inlet and exhaust ports of the first cylinder portion are opened to admit a fresh charge from the crankcase and to discharge a spent charge from the power stroke and the inlet and exhaust ports of the second cylinder portion are closed in a compression stroke.

10. A reciprocating piston machine as claimed in claim 7 in which:

i. the crankcase has a pair of spaced parallel generally plane side walls, and first and second generally semi-circular end walls connecting adjacent ends of the side walls so as to form a generally oval-sectioned crankcase, axes of arcs of the semi-circular end walls being generally within a central longitudinal plane of the crankcase, the guide means similarly having a central axis disposed within the central longitudinal plane, ii. the crankshaft axis is concentric with the axis of the first cylindrical end wall, iii. the gas pump is rotary and has a rotor journalled for rotation about an axis which is generally coincident with the axis of the second semi-cylindrical end wall.

11. A reciprocating piston machine as claimed in claim 7 in which the connecting member is characterized by:

i. the piston connecting arms being aligned to extend between the cylinders, ii. the crank connecting arm extending normally from the piston connecting arms, so as to form a generally "T" shaped connecting member.

12. A reciprocating piston machine as claimed in claim 3 in which the connecting member is characterized by:

i. the first and second piston connecting arms having equal lengths and inner ends thereof adjacent with the journal of the connecting member, ii. the crank connecting arm having a length generally equal to the length of a piston connecting arm with an inner end of the crank connecting arm being similarly adjacent the journal, so that the connector has three generally equal arms extending from the journal thereof.

13. A reciprocating piston machine as claimed in claim 7 in which:

i. each piston connecting arm has an outer end having an axially disposed slot disposed normally to the piston connecting arm and normally to the respective cylinder axis, ii. each piston has a wrist pin and journalling means cooperating therewith, the journalling means cooperating with the wrist pin and piston so that the piston can slide axially and simultaneously rotate relative to the piston connecting arm.

14. A reciprocating piston machine as claimed in claim 13 in which the journalling means of the piston includes a slide block having:

i. a bore to accept the wrist pin, and a pair of flat parallel faces disposed within planes parallel to a central axis of the wrist pin, the faces being spaced apart to provide a sliding fit of the slide block in the slot at the end of the piston connecting arms.

* * * * *